US008387649B2

(12) United States Patent
Parks et al.

(10) Patent No.: US 8,387,649 B2
(45) Date of Patent: Mar. 5, 2013

(54) TANK CONDENSATION DRAIN

(75) Inventors: Berlie E. Parks, Lawrenceburg, IN (US); William Alan Bryant, Greensburg, IN (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 471 days.

(21) Appl. No.: 12/714,599

(22) Filed: Mar. 1, 2010

(65) Prior Publication Data

US 2011/0209776 A1 Sep. 1, 2011

(51) Int. Cl.
*F16T 1/00* (2006.01)

(52) U.S. Cl. ..... 137/203; 137/177; 137/206; 137/590

(58) Field of Classification Search ..... 137/203, 137/206, 177, 590, 565.18
See application file for complete search history.

(56) References Cited

U.S. PATENT DOCUMENTS

| | | | | |
|---|---|---|---|---|
| 982,734 | A | 1/1911 | Martinelli | |
| 1,235,316 | A | 7/1917 | Henderson | |
| 1,471,528 | A | 10/1923 | Rawcliffe | |
| 1,522,300 | A | 1/1925 | Johnson | |
| 1,524,739 | A | 2/1925 | Lester | |
| 1,625,385 | A | 4/1927 | Benedict | |
| 1,718,473 | A * | 6/1929 | McCutchen | 431/231 |
| 3,214,054 | A * | 10/1965 | Poethig et al. | 220/240 |
| 4,289,617 | A | 9/1981 | Davis | |
| 5,269,338 | A | 12/1993 | Figas | |
| 5,353,835 | A * | 10/1994 | Mills | 137/590 |
| 6,015,111 | A * | 1/2000 | Berke | 242/394 |
| 7,413,414 | B2 * | 8/2008 | Wood et al. | 417/234 |

* cited by examiner

*Primary Examiner* — Craig Schneider
(74) *Attorney, Agent, or Firm* — Jones Day

(57) ABSTRACT

A drain for a pressure vessel includes a valve, a knob, a tube, a passageway, and a drain cup. The valve is coupled between an interior surface and an exterior surface of a tank. The knob is coupled to the valve for opening and closing the valve. The tube has a top end and a bottom end and is coupled to the valve at an interior surface of the tank at the top end and extends into a bottom of the tank at the bottom end. The passageway extends through the valve and has an opening coupled to the tube at a first end and an exit at a second end. The passageway is openable and closeable by the knob. The drain cup is associated with the exit of the passageway and is positioned on an exterior surface of the tank for collecting condensation from the interior of the tank. The valve is positioned at a height that is vertically higher than the bottom end of the tube.

12 Claims, 5 Drawing Sheets

TANK CONDENSATION DRAIN

FIELD

This technology relates to a condensation drain for a tank, such as an air compressor tank or other pressure vessel. In particular, this technology concerns a tank condensation drain with an integrated collection cup.

BACKGROUND

Air compressors, pressure vessels and tanks may collect moisture, condensation, or other fluids. The presence of such fluids inside a tank can cause corrosion. It is desirable to drain the fluid from a tank in order to avoid any adverse side effects caused by the accumulated condensation. It is also desirable to provide a vessel for storing the condensate once it has been removed from the tank until it may be disposed of in an appropriate manner. For example, if working inside away from a sink, it is appropriate to store the condensate in a cup until the user can properly dispose of the condensate in a sink or outside.

SUMMARY

An example tank condensation drain is described and claimed.

BRIEF DESCRIPTION OF THE DRAWING FIGURES

DETAILED DESCRIPTION

Figure 1:
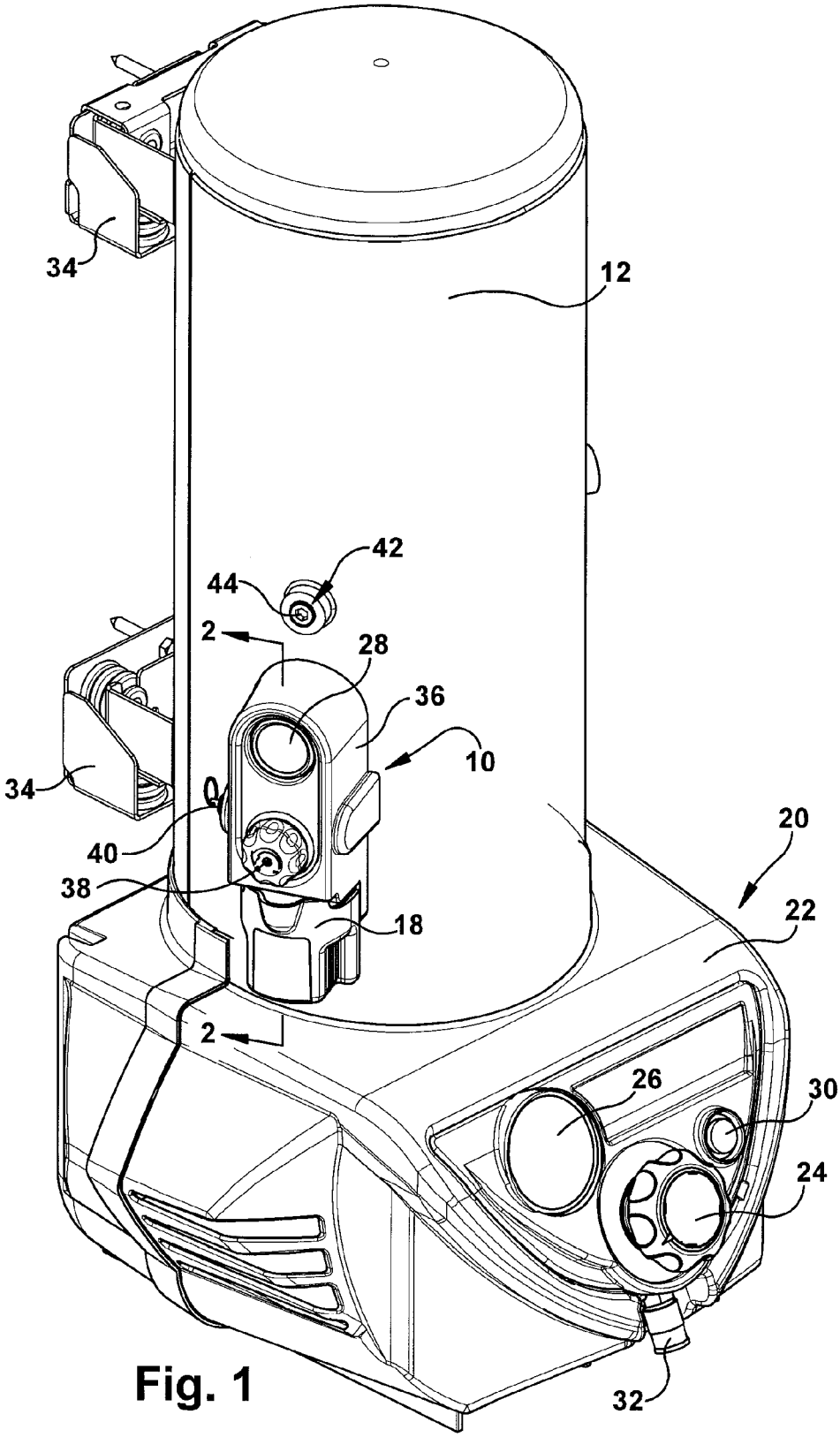
FIG. 1 is a perspective side view of an air compressor tank positioned on top of a compressor shroud showing the example drain mechanism.

The example tank condensation drain mechanism 10 is utilized with any type of pressure vessel 12, including an air compressor or the like. The example drain 10 is utilized to remove liquid condensation 14 from the bottom 16 of a tank 12 and includes a drain or collection cup 18 for collecting any liquid 14 that is removed. The collection cup 18 is removable and replaceable so that the cup 18 may be emptied at an appropriate location, which is typically away from the location of the pressure vessel 12 (such as in a sink). The example drain 10 is advantageous in helping to deter corrosion of the tank 12 that is often caused by condensation build up in cases where the condensation cannot be easily removed. The example drain 10 provides an efficient mechanism for draining a significant amount of condensation or liquid 14 from the interior of a pressure vessel 12, thereby prolonging the life of the pressure vessel 12.

Figure 7:
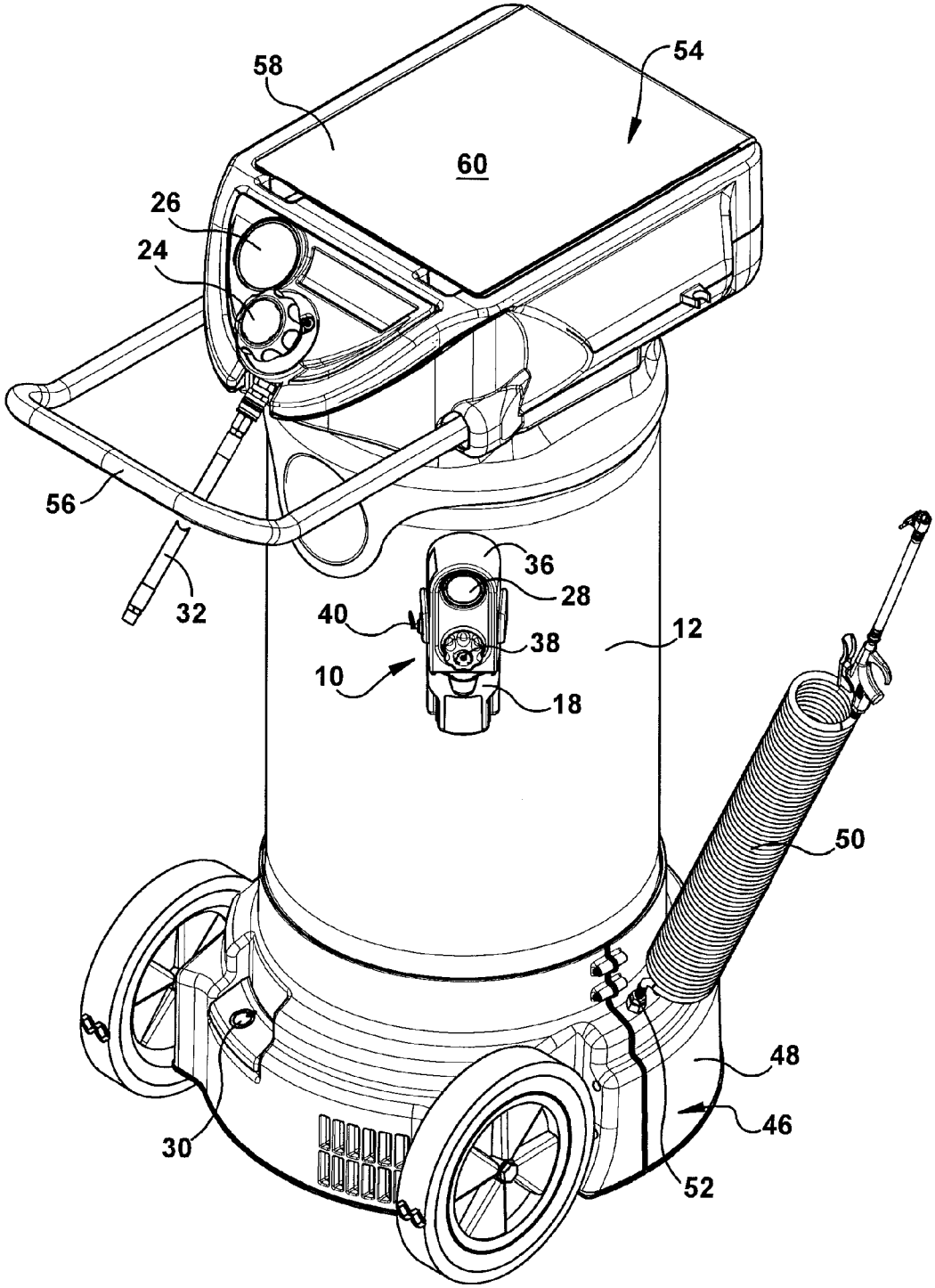
FIG. 7 is a perspective view of a different air compressor that incorporates the features of the example drain mechanism.

FIGS. 1 and 7 depict example pressure vessels 12 in the form of portable air compressors that may typically be used in home improvement projects. The air compressor in FIG. 1 includes a base unit 20 having an exterior shroud 22 that includes the motor. A pressure vessel or tank 12 is shown positioned on the base unit 20. The bottom 16 of the pressure vessel 12, as shown in later figures, is preferably rounded and seats in the shroud 22 of the base unit 20. The example drain mechanism 10 is coupled to an exterior surface of the tank 12. The air compressor includes a control knob 24 for modifying the pressure level of the air that is output from the tank. A first dial or gauge 26 displays the pressure level associated with the control knob 24. A second dial or gauge 28 is positioned on the pressure vessel 12 near the drain mechanism 10 and displays the pressure of air within the tank 12. An on/off button 30 and a hose connection 32 for coupling to an air hose (not shown) are also positioned on the base shroud 22. The device also includes connectors 34 for coupling the tank to a wall or other structure.

The drain mechanism 10 in FIG. 1 is associated with a cosmetic shroud 36 that is positioned on the side of the pressure vessel 12. The cosmetic shroud 36 has both cosmetic and functional attributes. The exterior parts of the drain mechanism include a drain control knob 38 and a drain cup 18. A safety valve 40 is also positioned on a side of the cosmetic shroud 36 and is utilized to release pressure from the pressure vessel 12 should the pressure inside the vessel exceed a prescribed amount. A tank flange 42 is also positioned on an exterior surface of the pressure vessel 12. This flange 42 may be utilized to daisy-chain multiple satellite compressor tanks to the main pressure vessel 12. The flange 42 has a plug 44 that seals off the opening within the flange 42. Additional pressure vessels can be daisy-chained to the main tank 12 in order to increase the capacity of the tank, or to provide portable tanks for use at a location that is spaced from the main tank 12.

The air compressor shown in FIG. 7 has many similarities to the device shown in FIG. 1, but is a wheeled version of the same device. The device in FIG. 7 is larger and is positioned on a rolling base 46 so that the device may be easily transported. The base 46 includes a shroud 48 that hides a motor for operating the compressor. An on/off switch 30 is positioned on the base 46. In addition, a peripheral hose 50 is coupled to a top surface of the base 46 and includes a connector 52 for connecting the hose 50 to the base 46. This peripheral hose 50 may be utilized for rapid inflation.

A pressure vessel or tank 12 is positioned on top of the base 46 and includes an example drain mechanism 10 positioned on an exterior side surface of the tank 12. Additional controls are positioned on a top shroud 54 that includes a handle 56 for use in wheeling the compressor around. The controls positioned on the top shroud 54 include a control knob 24 for controlling the output air pressure, a dial or gauge 26 that displays the pressure level setting for the control knob 24, and an outlet hose connector 32. The top shroud 54 also includes a storage area 58 that is hidden under a top lid 60. This top lid 60 may be removed in order to allow a user to position a tool kit on the top of the device. The drain mechanism 10 is again positioned on the side of the pressure vessel 12, and, like the device in FIG. 1, includes a shroud 36, a gauge or dial 28 that displays the interior pressure level of the vessel, a drain control knob 38, a collection cup 18, and a safety valve 40. Other orientations and configurations of compressors may be utilized with the example drain mechanism 10, the examples described herein not being limited to the exact compressors shown.

Referring now to FIGS. 2-6, the example drain mechanism 10 is coupled to the cosmetic shroud 36 that is positioned on an exterior side surface of a pressure vessel 12. A tank pressure gauge 28 and a safety valve 40 are coupled to the shroud 36, as well as the example drain mechanism 10. The example drain mechanism 10 includes a drain control valve 64, a flexible tube 62 coupled to the valve 64, a weight 66 coupled to the end of the flexible tube 62 to keep the tube 62 at the bottom 16 of the tank or pressure vessel 12, a fluid outlet 68 on the valve 64, and a cup 18 to collect the drained fluid 14. A drain control knob 38 is coupled to the valve 64.

Figure 2:
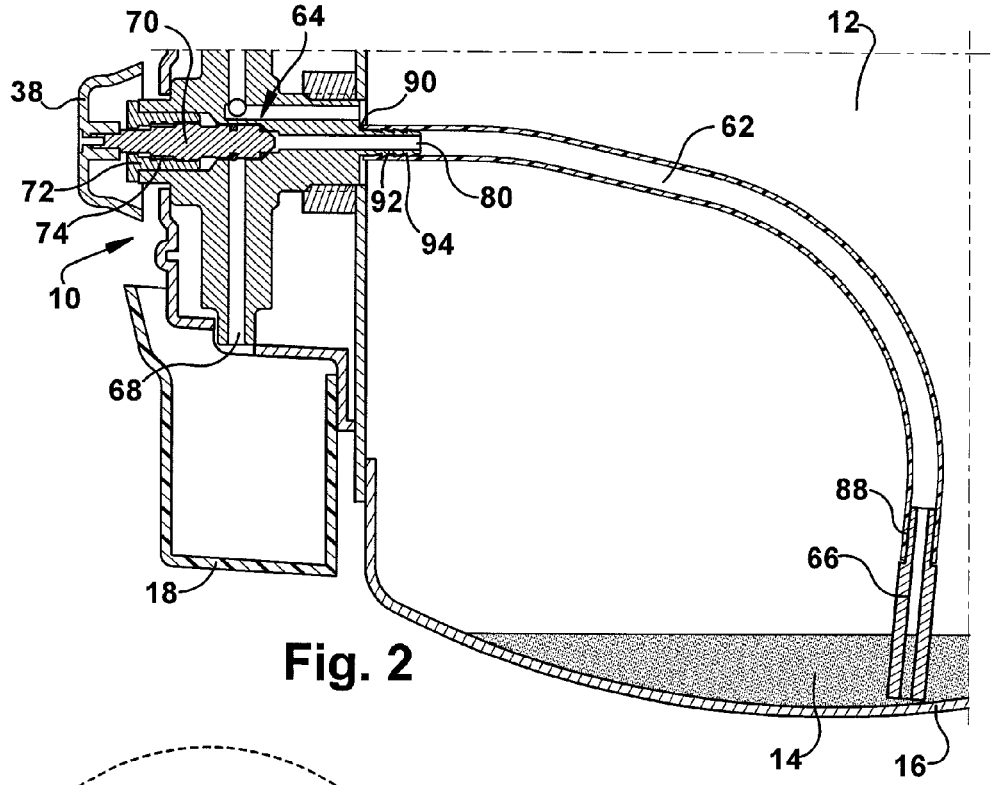
FIG. 2 is a partial cross-sectional view of the tank and example drain mechanism taken at line 2-2 in FIG. 1 showing the drain in a closed position.
Figure 3:
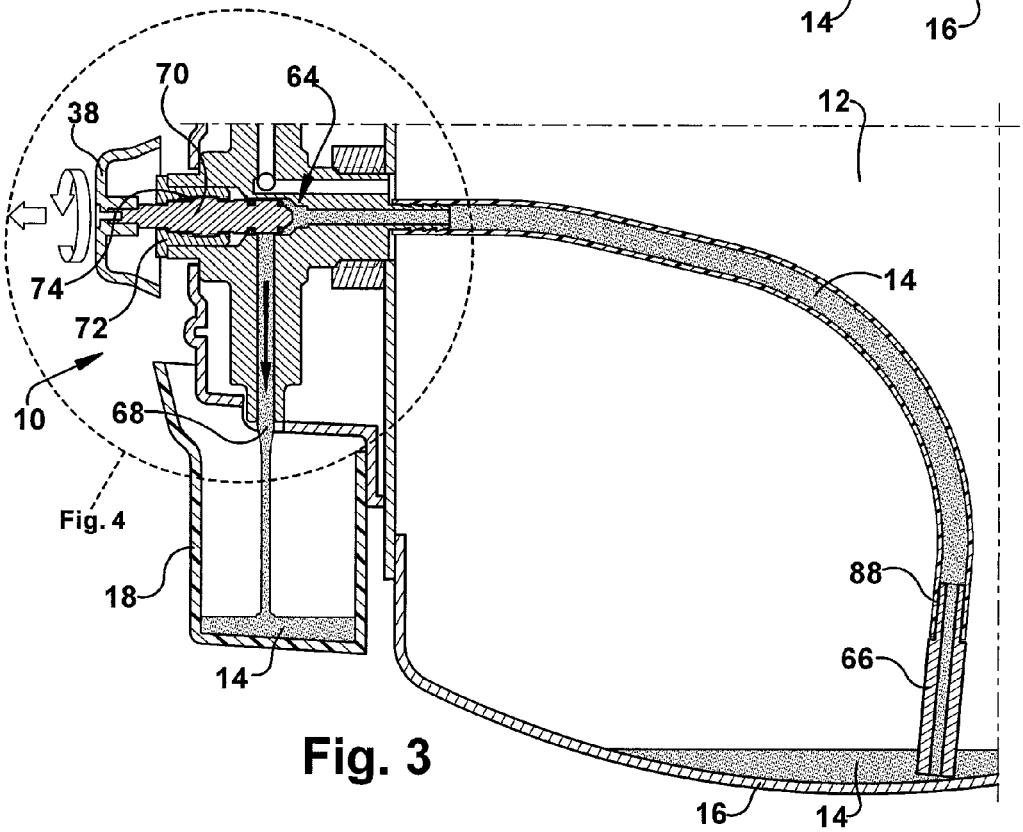
FIG. 3 is a partial cross-sectional view similar to FIG. 2, but with the example drain in an open position, with fluid collecting in the drain cup.
Figure 4:
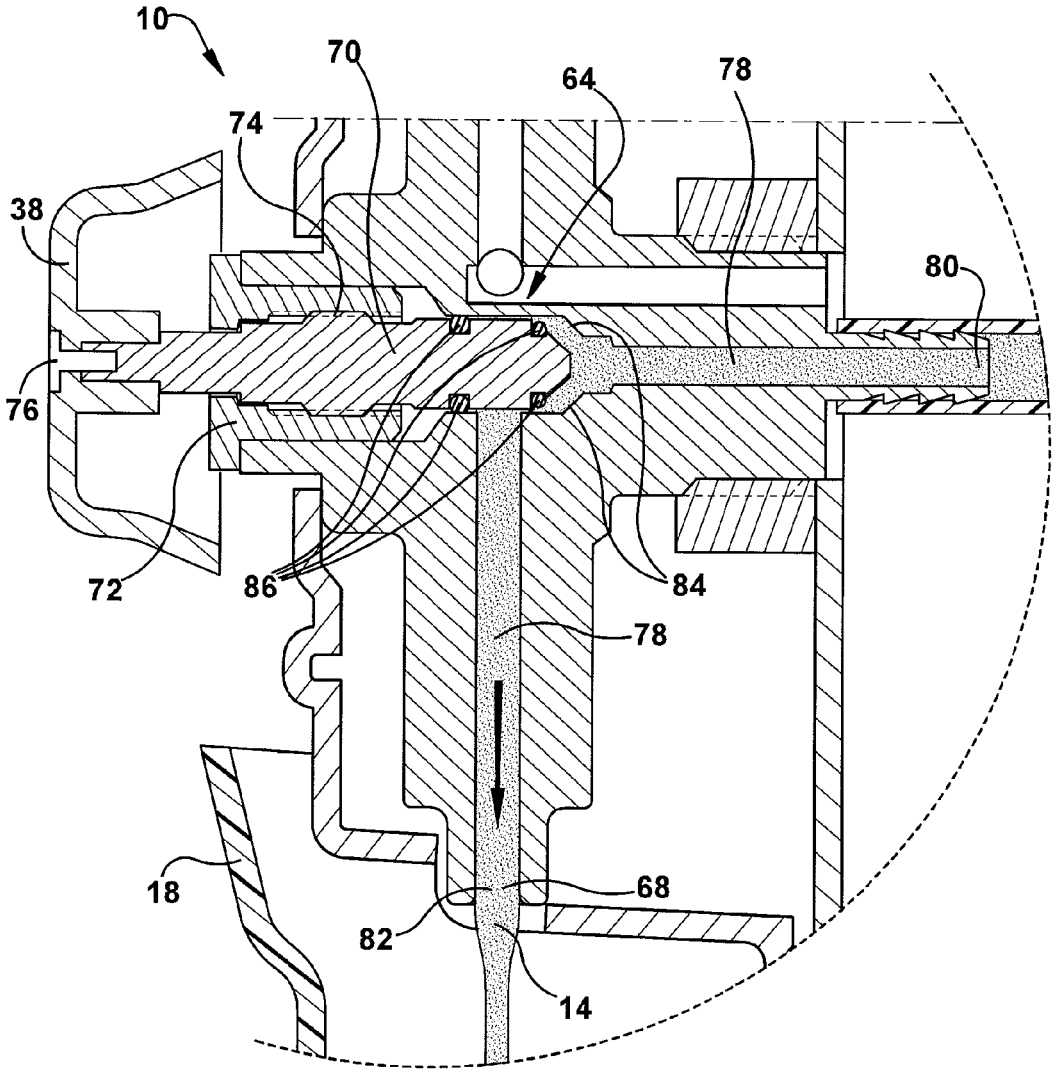
FIG. 4 is an exploded view of the valve mechanism of the example drain, taken from FIG. 3.

FIG. 2 shows the drain control knob 38 in a closed position and FIG. 3 shows the drain control knob 38 in an open position, with liquid 14 flowing into the collection cup 18. The valve assembly 64 has a drain shaft 70 that is coupled to the drain control knob 38, with the drain shaft 70 being positioned in a shaft bushing 72 that includes screw threads 74. The drain control knob 38 is coupled to the drain shaft 70 with a screw 76 or other known connection technique. The drain shaft 70 moves in and out when the drain control knob 38 is rotated. A passageway 78 extends through the valve 64 and communicates between the inlet 80 to the valve and the outlet 82 of the valve. The inlet 80 to the valve is coupled to the siphon tubing 62 and the outlet 82 communicates with the drain cup 18.

The valve 64 has a closed position, shown in FIG. 2, and an open position, shown in FIG. 3. The drain shaft 70 seats against an inner contoured surface 84 of the passageway 78 to block the passageway 78 when in the closed position. When the drain control knob 38 is rotated such that the drain shaft 70 moves away from the inner contoured surface 84 of the passageway 78, the passageway 78 becomes open and liquid may then flow around the drain shaft 70 and exit the valve 64 through the outlet 82 into the drain cup 18. The drain shaft 70 may include several seals, such as the O-rings 86 shown, for sealing the drain shaft 70 when the valve 64 is in a closed position.

The drain mechanism 10 operates by utilizing the pressure in the tank 12. When the tank 12 is under pressure, the pressure level in the tank 12 will be greater than atmospheric. As a result, when the drain valve 64 is opened, the pressure in the tank forces the liquid 14 at the bottom 16 of the siphon tube 62 out through the passageway 78. The weight 66 at the bottom of the siphon tube 62 helps to maintain the siphon tube 62 at the bottom 16 of the tank 12. The weight 66 is cylindrical and has a cylindrical opening for mating with the passageway inside the siphon tube 62. The weight 66 preferably seats inside the siphon tube 62 with a press fit. The weight 66 preferably has a portion 88 that is sized for seating inside the siphon tube 62, as shown, although other techniques may be utilized for coupling the weight 66 to the tube 62. In addition, at the upper end 90 of the tube 62, the valve 64 includes a nipple 92 that the siphon tube 62 seats around. The nipple 92 has teeth 94 to assist in grabbing the suction tube 62.

The bottom 16 of the pressure vessel 12 has a continuously curved surface so that the weight 66 cannot create a suction directly against the bottom wall 16 of the pressure vessel 12. Alternatively, the weight 66 can be designed such that it has a contour, curvature, or other shape that would prevent it from suctioning against the bottom 16 of the tank 12, if desired.

Figure 6:
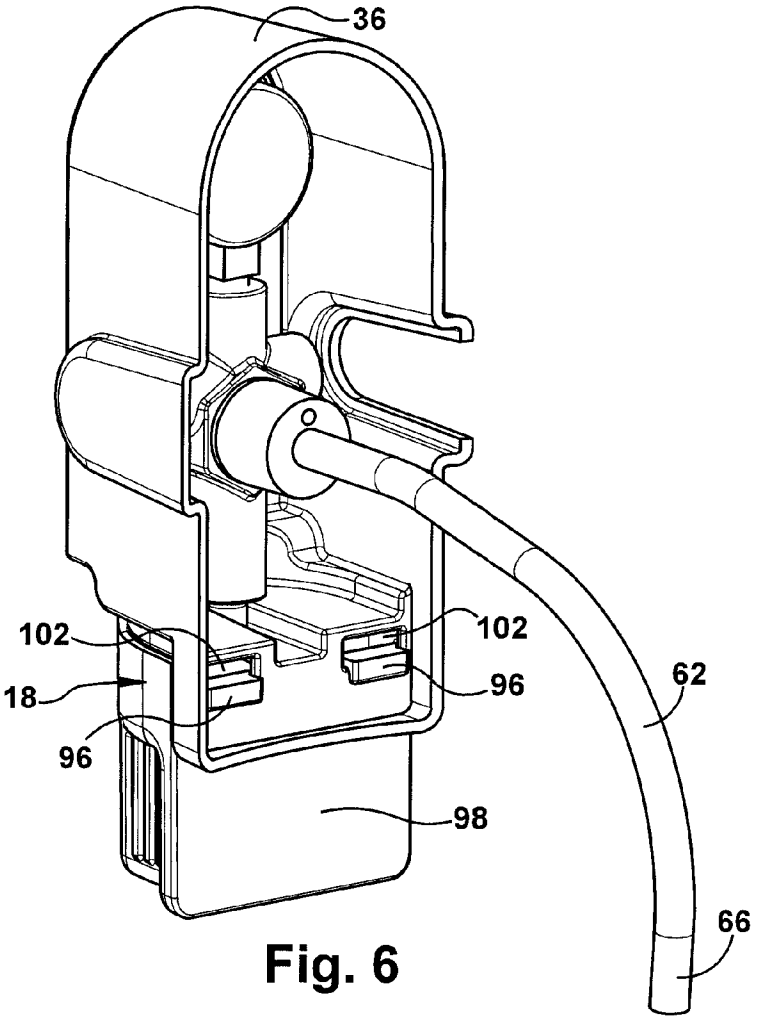
FIG. 6 is a rear perspective view of the drain cup installed on the shroud of the example drain.
Figure 5:
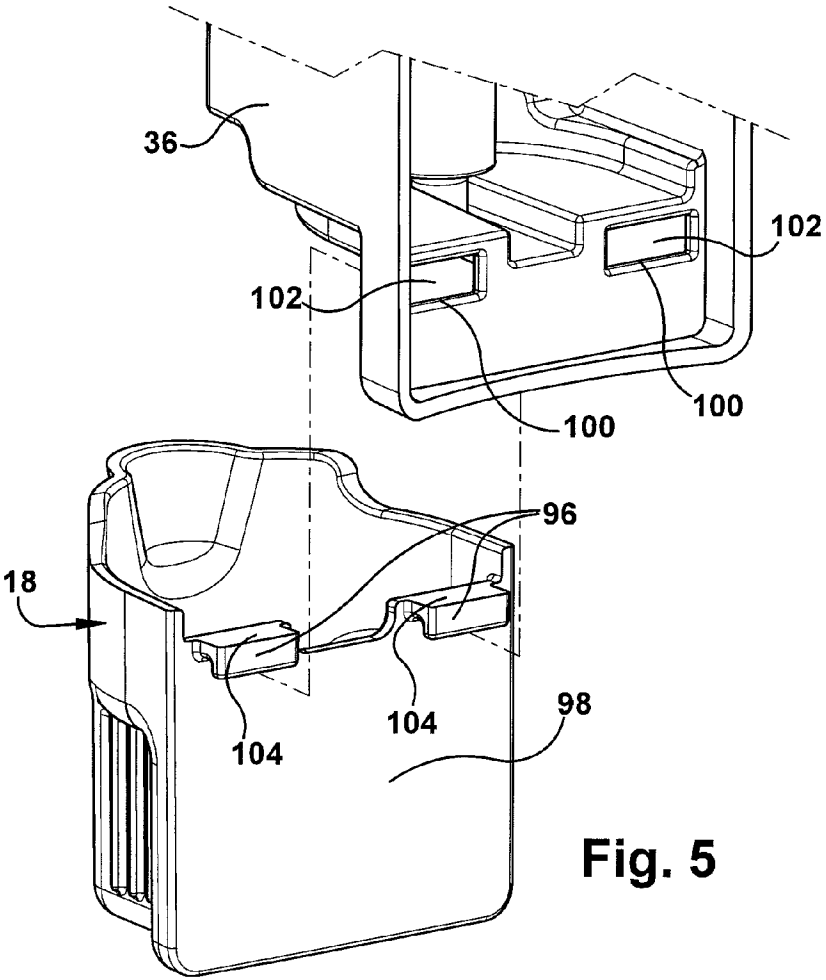
FIG. 5 is a perspective view of the drain cup of the example drain removed from the shroud.

The collection or drain cup 18 is shown best in FIGS. 5 and 6 and may be made of a semi-transparent material, such as polycarbonate, so that the user can see when the cup is getting full. Other materials may also be utilized. The cup may be non-transparent or may have only a portion that is transparent, if desired.

The drain cup includes two downwardly facing hooks 96 positioned on the back face 98 of the cup 18. These hooks 96 are configured to seat on ledges 100 that are defined at the back of the cosmetic shroud 36. The cosmetic shroud 36 has openings 102 that are slightly larger than the size of the hooks 96 so that the hooks 96 can enter through the openings 102 and them move downwardly to seat on the ledges 100 that are defined below the openings 102. In use, the user slides the cup 18 rearwardly until the hooks 96 enter the openings 102 in the rear of the shroud 36. Then the cup 18 is lowered until the horizontal surfaces 104 of the hooks meet the ledges 100. The cosmetic shroud 36 is preferably undercut to allow the cup 18 to slide under the shroud 36 to mate with the ledges 100. The cup 18 hangs on the shroud 36 via gravity and by leveraging against the cosmetic shroud 36 surface. The cup 18 serves as a counter weight against the shroud 36.

Other attachment techniques may also be utilized with the collection cup 18. It is preferred that the attachment technique provide a smooth transition on and off the shroud 36 since the cup 18 will be filled with liquid 14 and it is desired not to jar the cup 18 and its contents. Another type of attachment technique that could be utilized is sliders on either side of the cup, with ledges being provided on the interior of the shroud for mating with similarly defined appendages on the cup. Other attachment techniques may also be utilized.

In operation, the valve 64 is opened, the flexible tube 64 and weight 66 siphon the fluid 14 from the bottom 16 of the tank 12 through the open valve 64. The fluid outlet 68 then directs the drained fluid 14 to the cup 18. The fluid 14 is collected in the cup 18 until the user can dispose of it in an appropriate manner. The user will typically purge the tank 12 of liquid 14 and then close the drain valve 64 by rotating the knob 38 when the cup 18 becomes full or when liquid 14 is no longer exiting the tank 12.

The various parts of the pressure vessel and valve may be made of any material desired. Metal or plastic materials may be utilized, as known by those of skill in the art. The siphon tube is preferably made of a plastic material. The weight is preferably made of a non-corrosive material, but other materials, such as other metals or heavy weight plastics, may also be utilized.

The term "substantially," if used herein, is a term of estimation. While various features of the claimed invention are presented above, it should be understood that the features may be used singly or in any combination thereof. Therefore, the claimed invention is not to be limited to only the specific embodiments depicted herein.

Further, it should be understood that variations and modifications may occur to those skilled in the art to which the claimed invention pertains. The embodiments described herein are exemplary of the claimed invention. The disclosure may enable those skilled in the art to make and use examples having alternative elements that likewise correspond to the elements of the invention recited in the claims. The intended scope of the invention may thus include other examples that do not differ or that insubstantially differ from the literal language of the claims. The scope of the present invention is accordingly defined as set forth in the appended claims.

What is claimed is:

1. A drain for a tank comprising:

a valve coupled between an interior surface and an exterior surface of a tank;

a knob coupled to the valve for opening and closing the valve;

a tube having a top end and a bottom end, said tube being coupled to the valve at an interior surface of the tank at the top end and extending into a bottom of the tank at the bottom end;

a valve passageway extending through the valve and having an opening coupled to the tube at a first end and an exit at a second end, with the valve passageway being openable and closeable by the knob; and a drain cup associated with the exit of the valve passageway positioned on an exterior surface of the tank for collecting condensation from the interior of the tank, wherein the valve is positioned at a height that is vertically higher than the bottom end of the tube.

2. The drain of claim 1, further comprising a weight positioned at the bottom end of the tube.

3. The drain of claim 2, wherein the weight is seated against a bottom surface of the tank.

4. The drain of claim 1, wherein the valve has an open position and a closed position, and when the tank is under pressure greater than atmospheric pressure outside the tank and the valve is in the open position, a pressure differential is provided to drive a flow of condensation from the bottom of the tank through the valve passageway into the drain cup.

5. The drain of claim 4, wherein the valve includes the knob, a drive shaft, and a shaft bushing, with the drive shaft being positioned in the shaft bushing and axially coupled to the knob, said knob being rotatable relative to the bushing to move the drive shaft from the closed to the open position such that when the drive shaft is in an open position, liquid may be driven through the tube, though the valve passageway, and into the drain cup.

6. The drain of claim 1, wherein part of the valve passageway is horizontal and part of the valve passageway is vertical.

7. The drain of claim 1, wherein the drain cup is removable and replaceable on an exterior surface of the tank.

8. The drain of claim 1, further comprising a shroud positioned around the valve and coupled to an exterior surface of the tank, with the shroud having features for mating with features on the drain cup.

9. The drain of claim 1, wherein the tube is flexible and is coupled to a nipple that extends from the valve into the tank at a top end of the tube.

10. An apparatus comprising:

a tank containing air at a pressure greater than atmospheric pressure at the exterior of the tank, and also containing liquid at a bottom of the tank;

a valve having an actuator at the exterior of the tank;

a hydraulic line that extends through the valve, has an inner end with an inlet submerged in the liquid at the bottom of the tank, and has an outer end with an outlet that is open to the atmospheric pressure at the exterior of the tank, with the outlet located vertically above the inlet; and a collection cup detachably mounted on the exterior of the tank in a position where the cup receives liquid condensation discharged from the outlet.

11. An apparatus as defined in claim 10 wherein the inner end of the hydraulic line is weighted to rest on the bottom of the tank under the force of gravity.

12. An apparatus as defined in claim 10 wherein the actuator comprises a manually rotatable knob.

* * * * *